US005353520A

United States Patent [19]

Gougé et al.

[11] Patent Number: 5,353,520

[45] Date of Patent: Oct. 11, 1994

[54] PIN OVEN SYSTEM FOR CANS

[75] Inventors: Steven E. Gougé, Sussex; Edward S. Napoleon, Milwaukee, both of Wis.

[73] Assignee: Oven Systems, Inc., Milwaukee, Wis.

[21] Appl. No.: 72,604

[22] Filed: Jun. 4, 1993

[51] Int. Cl.[5] ..... F26B 25/00

[52] U.S. Cl. ..... 34/105; 432/121

[58] Field of Search ..... 34/105, 104; 432/124, 432/122, 230, 121

[56] References Cited

U.S. PATENT DOCUMENTS 3,381,391 5/1968 Yunghahn .
4,052,152 10/1977 Whelan et al. .
4,053,993 10/1977 Schregenberger .
4,662,085 5/1987 Russo et al. .

*Primary Examiner*—Henry A. Bennet
*Attorney, Agent, or Firm*—Andrus, Sceales, Starke & Sawall

[57] ABSTRACT

A high speed pin oven for drying the exterior coatings on open ended cans includes a U-shaped duct through which the cans mounted on a conventional pin chain are conveyed with the side and end walls of the duct provided with orifice patterns to direct high velocity heated air against the can bottoms and side walls to provide rapid heat up and drying. The uniform high velocity air flows also help stabilize the cans against movement, thereby preventing damage and dislodgement from the carrier pins. The generally vertical serpentine chain path through the oven includes substantially larger diameter turn sections which are defined by a series of circumferentially spaced small diameter sprockets to significantly reduce the affects of centrifugal force on the cans traveling through the turns. The combination of rapid drying and high chain speed provides a much smaller pin oven with greater can capacity. Energy consumption and operating costs may be reduced by more than 50% with a similar reduction in combustion exhaust emissions.

13 Claims, 3 Drawing Sheets

FIG. 1
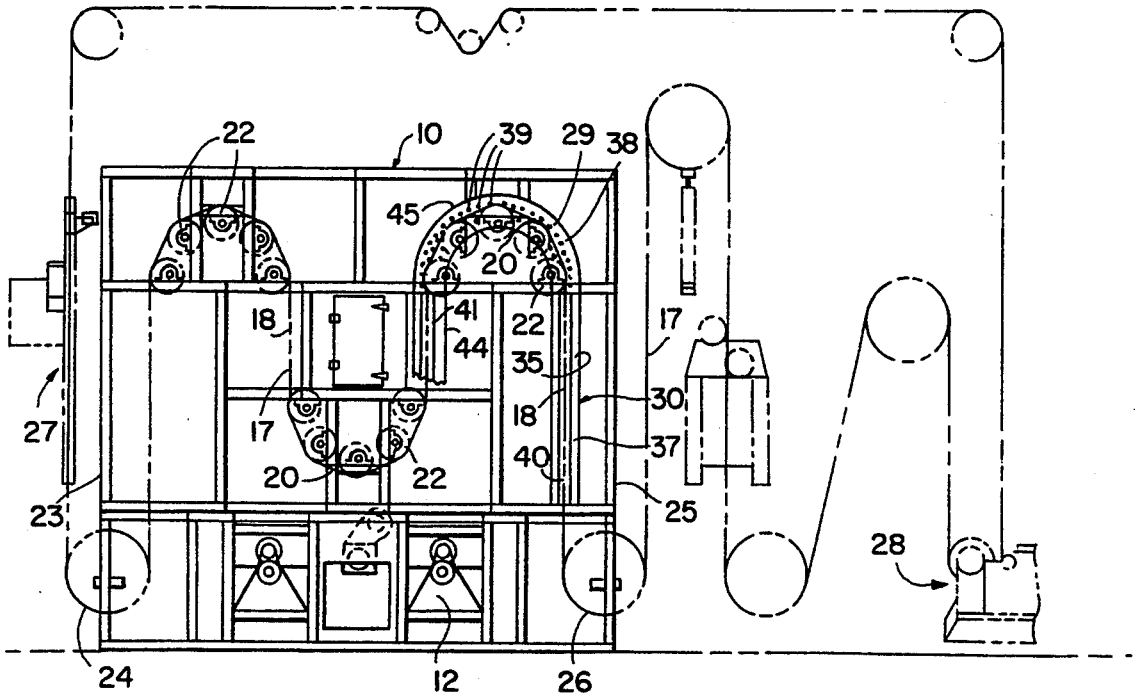
FIG. 3
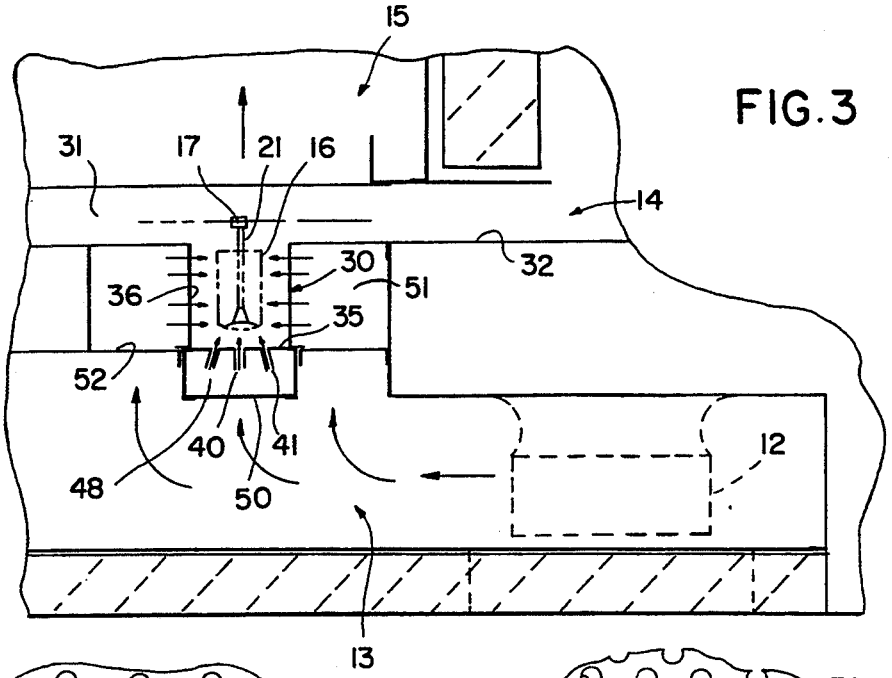
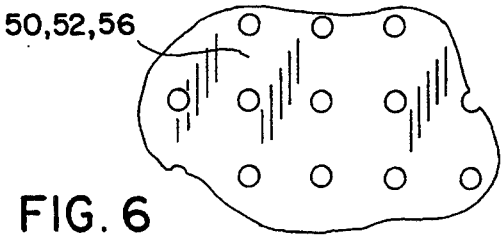
FIG. 6
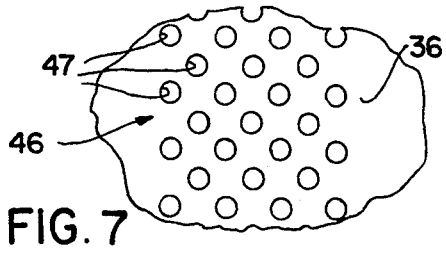
FIG. 7

PIN OVEN SYSTEM FOR CANS

BACKGROUND OF THE INVENTION

The present invention pertains to ovens for drying containers and, more particularly, to so-called pin ovens for drying open-ended cans.

Pin ovens are well known in the art and are widely used in the industry for drying the coating on the exterior of partially completed, open-ended beverage cans. The coating applied to the exterior of the cans may include the ink or enamel used to apply the label, an overcoat of lacquer or varnish, or both a printed label and overcoat. U.S. Pat. No. 3,381,391 shows a basic pin oven construction which has remained essentially the same and is in current use throughout the industry. A typical pin oven includes a conveyor chain mounted for movement in a generally vertical serpentine path defined by a series of straight runs connected by curved turn single sprocket sections. Extended carrier pins are attached to the conveyor chain in spaced relation along its entire length and open-ended cans are placed onto the extended pins and are carried over the serpentine path through the oven. Nozzles aligned with the chain path and the cans direct heated air against the outsides of the cans as they travel through the oven.

The heated air streams are also intended to help hold the cans on the chain pins and, therefore, most pin ovens include nozzle arrangements which continuously direct heated air against the can bottoms. In addition, attempts have been made to utilize the flow of heated air against the can bodies to stabilize the cans on the pins and to prevent the cans from flopping on the pins as a result of air flow variations or centrifugal force as the cans pass around the curved turn sections between adjacent vertical runs. U.S. Pat. No. 4,662,085 shows a more recent pin oven construction intended to promote uniform and rapid drying, while eliminating can flopping or flutter over the path of movement through the oven. This patent discloses the use of heated air streams directed angularly along the can side walls, as well as against the can bottoms. The pin oven disclosed in this patent is described as having a maximum capacity of 1,500 cans per minute.

Attempts have also been made to reduce can residence time in the oven and simultaneously reduce the oven size by substantially increasing the temperature of the drying air. In prior art device, utilizing a chain speed sufficient to process 1,500 cans per minute, drying air temperatures up to about 750° F. (400° C.) were used. However, line stoppage in pin oven systems is a common occurrence and, when cans are held at such elevated temperatures, they begin to soften and distort and create serious quality problems.

U.S. Pat. No. 4,053,993 shows another approach which is intended to eliminate the problems attributed to pin ovens, particularly the inability to adequately stabilize the cans and to direct drying air to the can interiors as well. In the system of this patent, cans are conveyed open end down on a perforated or open conveyor belt and gentle flows of air are imparted from above and both sides through the walls of a three-sided duct through which the conveyor and cans move. A part of the flow of heated air is caused to circulate upwardly through the open conveyor and into the can interiors. However, because the cans are standing on their open ends without any supporting pins or other devices extending into the can interior, the heated air flows must of necessity be of low velocity, particularly where a part of the flow is directed from below into the can interior. This is also a high temperature system and, when used to process a single line of cans, is only capable of handling approximately 1,000 cans per minute.

It is also known to dry inks and finishes applied to the exterior of cans in pin ovens in which the pins include holding means which contact the entire cylindrical interior of the cans and hold them centered on the pins as the pin chain travels through the oven. Means are also provided to cause the pins to rotate on their axes, thereby causing the cans to also rotate as they travel through the oven for more uniform drying. One version of such a drying oven is shown in U.S. Pat. No. 4,052,152 which includes an embodiment in which the can is not held centered on the pin and is dried by gas flames made to directly impinge on the can bottom and side walls. This arrangement is not known to have attained any measure of commercial success because of the propensity to burn the coatings and inability to attain can drying uniformity.

Can manufacturing plants utilizing pin ovens typically operate around the clock, seven days per week. Energy consumption, both in terms of natural gas used to fuel the air heaters and electricity to operate the blower motors, is very substantial. Energy cost savings are, therefore, extremely important. Thus, the ability to process cans in greater volumes with lower residence time in the oven and without increasing air temperature above a desirable maximum of about 415° F. (213° C.), would provide a substantial saving in energy costs. In addition, reducing the amount of natural gas used in the air heaters will also substantially lower the level of potentially hazardous emissions of $NO_x$ and carbon monoxide.

Finally, conventional pin ovens of the type initially described hereinabove have now reached practical limits of can drying speeds and capacities. Thus, current limits on pin oven capacities of about 1,500 cans per minute are too low to accommodate the higher capacities of improved can decorating equipment and other can manufacturing and handling equipment served by the pin oven.

SUMMARY OF THE INVENTION

In accordance with the present invention, a high speed pin oven with a short can dwell time and substantially reduced chain length utilizes high velocity heated air from nozzles positioned to impinge substantially perpendicularly against the bottoms and side walls of the cans. The heated air jets are applied in a uniform manner along the full serpentine path of the conveyor chain, including the straight runs and turns in a manner which holds the cans stabilized on the pins to minimize can flopping. The turn sections are provided with large diameter multi-sprocket curves to minimize can movement on the pins resulting from centrifugal force and resultant can instability.

In accordance with the preferred embodiment of the present invention, a continuous U-shaped duct is provided along the entire length of the conveyor chain, including the straight runs and the connecting turn sections. The duct is positioned directly adjacent but spaced from a conveyor chain so that the can carrier pins on the chain and the cans mounted on the pins extend into the duct. The duct includes an end wall and a pair of opposed side walls which extend generally perpendicularly from the end wall. The end wall and side walls of the duct are provided with patterns of orifices extending uniformly along the full length of the duct for directing pressurized heated air through the duct walls in generally perpendicular directions against the bottoms and cylindrical walls of the cans. The direct impingement, high velocity heated air flows through the orifices cause the can coatings to dry faster and holds the cans stable on the chain pins so that the chain may be driven at a substantially higher speed while the length of the chain in the oven may be substantially reduced.

The orifice pattern in the continuous duct end wall preferably comprises a series of spaced slots extending along the lengths of the straight run portions of the duct lying parallel to one another. A uniform pattern of perforation is provided along the lengths of the end walls in the curved turn sections. The orifice patterns in the side walls, for both the straight run sections and the curved turn sections, preferably comprise arrays of equally spaced and sized perforations positioned directly adjacent the cylindrical can walls and having widths approximately equal to the height of the cans. The center slot in the end wall is preferably aligned with the conveyor chain and positioned to direct a flow of heated air directly against the bottom walls of the cans. The side slots positioned on each side of the center slot are positioned to direct converging flows of heated air against the corners of the cans defined by the junctures of the can bottoms and cylindrical walls. The center slot is wider than either of the side slots and, preferably, has a width greater than twice the width of either of said side slots.

In a further aspect of the invention, each curved turn section is defined by a series of sprockets which support the conveyor chain for movement around the turn. The sprockets are spaced circumferentially along the curve, which is generally semicircular, such that the conveyor chain between each adjacent pair of sprockets lies generally on a chord of the curve. Each of the sprockets has a diameter less than half the diameter of the curve and, in the presently preferred embodiment, each curved turn section utilizes five identical sprockets having diameters suitable to minimize the effects of angular acceleration around the turn.

BRIEF DESCRIPTION OF THE DRAWINGS

FIG. 1 is a generally schematic front elevation of a pin oven using the system of the present invention.

FIG. 3 is an enlarged horizontal section through a portion of the pin oven of FIG. 1.

FIG. 6 is a detail of the perforation pattern in the walls of the supply and return ducts.

FIG. 7 is a detail of the pattern of perforations for the duct side walls and curved end wall portions.

DETAILED DESCRIPTION OF THE PREFERRED EMBODIMENT

Figure 2:
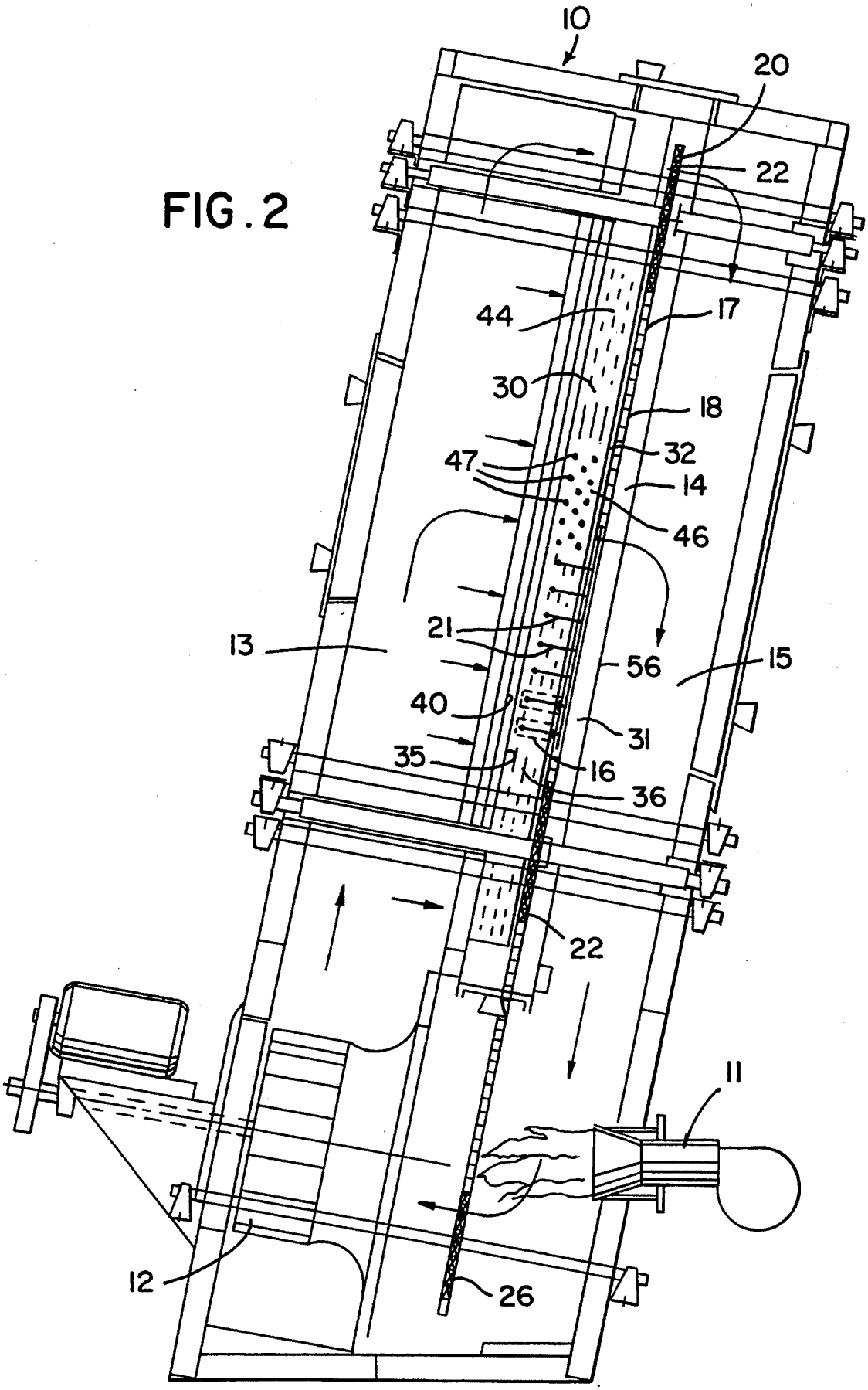
FIG. 2 is an enlarged end elevation of the pin oven shown in FIG. 1.

Referring initially to FIGS. 1 and 2, the pin oven is enclosed is a generally rectangular housing 10 which, in the end view of FIG. 2, is shown tilted rearwardly slightly to help maintain the cans on the pins in a manner well known in the art. Heated air is supplied to the interior of the housing 10 by a gas heater 11 and is circulated within the housing by a recirculating fan 12. The interior of the housing 10 is divided into a supply chamber 13 for the heated drying air, a drying chamber 14 through which the cans are circulated, and a return chamber 15 into which the drying air is directed to be returned and reheated by the heater 11 for recirculation.

The cans 16 are carried through the oven on a continuous length of conveyor chain 17 which is entrained to travel a vertical up-and-down serpentine path defined by a series of vertical straight runs 18 interconnected by upper and lower curved turn sections 20. In the embodiment shown, a four-pass oven includes four straight runs 18, each adjacent pair of which is interconnected by a curved turn section 20, two upper turn sections and a lower turn section.

The conveyor chain 17 may comprise a conventional roller chain, such as a No. 60 chain having a nominal $\frac{3}{4}$ inch (19 mm) chain pitch. Long extended can carrier pins 21 are attached to the conveyor chain 17 at equally spaced intervals along the length thereof in any of several well known manners. For example, the carrier pins 21 may comprise unitary extended chain connecting pins or they may be attached to more conventional chain connecting pins with a suitable coupling. The carrier pin spacing may conveniently be $5\frac{1}{4}$ inches which, on a $\frac{3}{4}$ inch pitch No. 60 roller chain, would locate a carrier pin 21 at each seventh connecting pin. In any event, the carrier pin spacing must be large enough to avoid any contact by adjacent cans 16 carried on the pins. The chain size and carrier pin spacing may, of course, be varied to accommodate different size cans but the foregoing described size and spacing has been found suitable for processing of a conventional open-ended 12 ounce beverage can having a nominal length of 4 13/16 inches and a diameter of 2 11/16 inches. The ends of the carrier pins 21 are usually provided with elastomer knobs to provide better stability to the cans and to prevent marring or scratching of the can finish.

In prior art pin ovens, the curved turn sections of the serpentine chain path are each typically provided by a single large diameter sprocket, typically 1 to 2 feet (30 to 60 cm) in diameter. In the preferred embodiment of the present invention, each turn section 20 is provided by a semicircular array of five small diameter sprockets 22 positioned in a circumferential arrangement to define a much larger diameter generally circular turn section. The sprockets 22 may be approximately 1 foot (30 cm) in diameter and arranged to define a turn section diameter of approximately 5 feet (1.5 m). The conveyor chain 17 thus extends between adjacent sprockets 22 in a turn section 20 generally along a chord of the large diameter circle. The larger diameter turn section results in a lower centrifugal force being imposed on the cans in the turns and thus helps maintain better can stability and eliminates can damage. This also allows the chain to be driven at a higher speed. Elimination of single large diameter sprockets eliminates a component that is costly to manufacture as well as one that is inherently difficult to manufacture accurately, large diameter sprockets being subject to greater wobble which, in turn, subjects the chain and cans to increased vibration and movement. In addition, larger diameter sprockets are subject to heat distortion inside the oven, a problem which becomes worse as oven temperatures are increased.

The conveyor chain 17 enters the oven housing 10 through an entry opening adjacent the lower end of the upstream end wall 25 where it passes around an upstream sprocket 26. Similarly, the chain exits the oven through an exit opening adjacent the opposite downstream end wall 23 around a downstream sprocket 24. The conveyor chain and cans mounted thereon may continue through a can cooling section 28 and, after the cans are cooled and removed from the chain, the chain returns to a can loading station associated with a can decorator 27.

The object of the present invention to reduce substantially the can drying time while simultaneously increasing substantially the capacity of the oven up to about 2,400 cans per minute is accomplished in part by the use of the foregoing large diameter turn sections 20. More importantly, however, the significant decrease in can curing time and the increase in chain speed leading to a significant increase in oven capacity are primarily attributable to the unique drying chamber 14 which directs high velocity heated air at the can from three sides, resulting in rapid drying and the maintenance of can stability throughout the length of the entire serpentine drying path.

Figure 4:
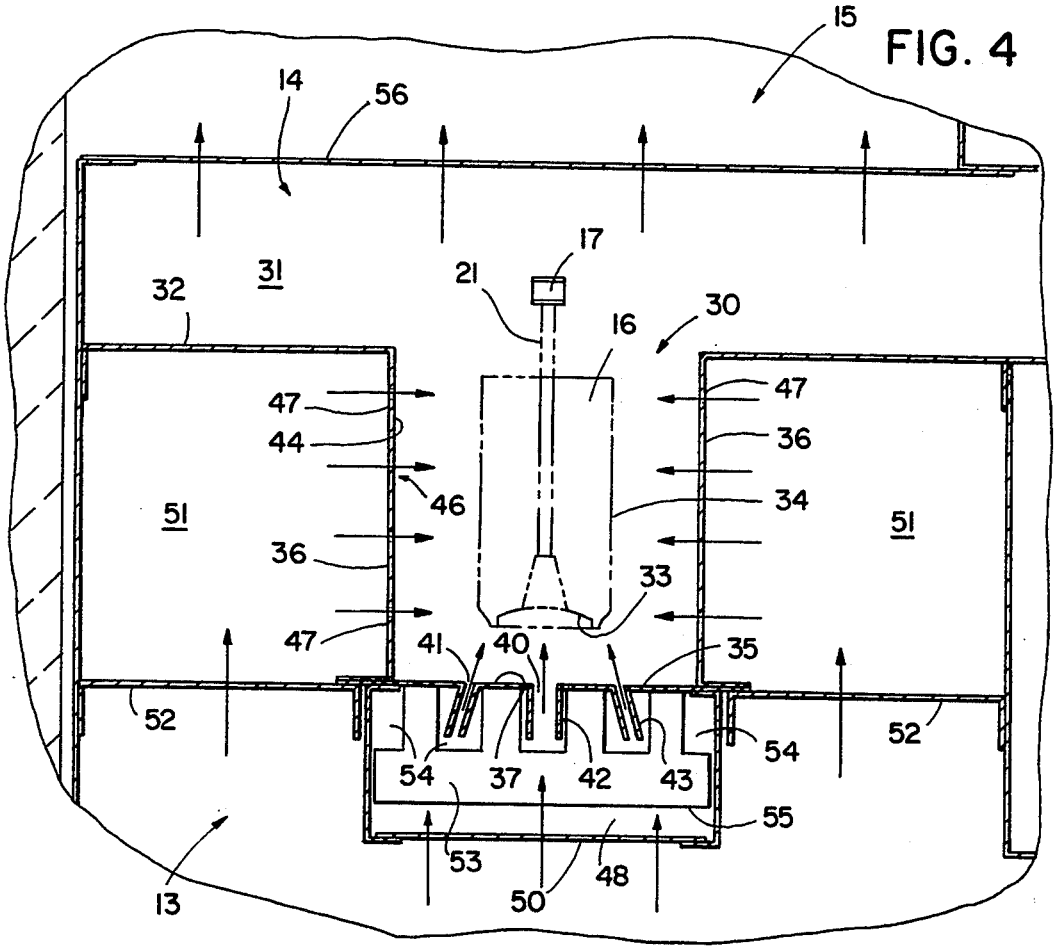
FIG. 4 is an enlarged portion of FIG. 2 showing details of the can heating duct.
Figure 5:
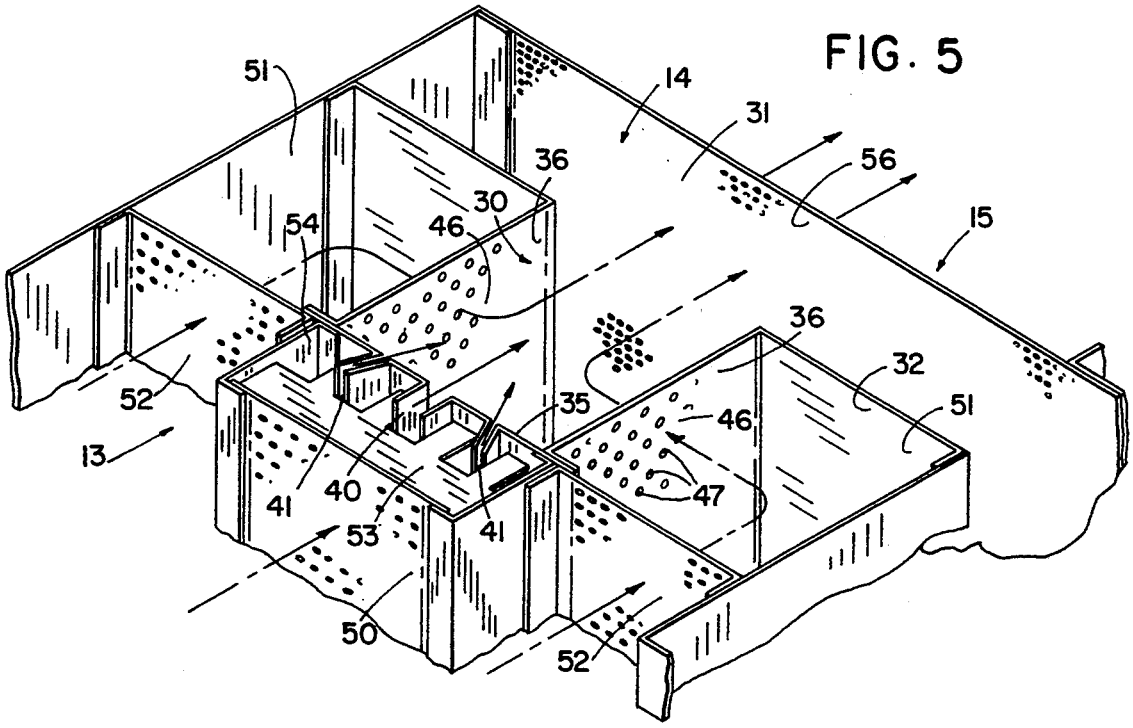
FIG. 5 is a perspective view of a portion of the can heating duct showing generally the air flow pattern therethrough.

Referring also to FIGS. 3–5, the drying chamber 14 includes a continuous open-faced duct 30 which is generally U-shaped in cross section and which is shaped and dimensioned to follow directly the path of the conveyor chain 17. The chain 17 and small diameter sprockets 22 are mounted in a common plane lying vertically within the main open portion 31 of the drying chamber 14. The continuous U-shaped duct 30 is formed in the front wall 32 of the drying chamber and is dimensioned and positioned such that the long extended carrier pins 21 extend into the duct. The cans 16 carried on the pins are positioned entirely within the duct and generally equally spaced from the walls thereof when the end of the carrier pin 21 is in engagement with the inside of the can bottom 33. If the cans are maintained centered on the carrier pins 21 (such that the cylindrical can walls 34 lie coaxially on the pins), the cans will remain centered in the duct 30 throughout their full path of travel therein.

The U-shaped duct 30 through which the cans are conveyed includes an end wall 35 and a pair of opposed side walls 36. The side walls 36 are parallel to one another and extend generally perpendicular to the end wall 35 such that the U-shaped duct is preferably rectangular. Heated pressurized air is directed from the supply chamber 13 into the duct 30 through special patterns of orifices in the end wall 35 and side walls 36.

The end wall 35, over the full length of the duct, includes alternate interconnected straight run end walls 37 and curved turn section end walls 38. The straight run end walls are provided with a series of three longitudinally extending slots. The slots include a center slot 40 and a pair of side slots 41, one on each side of the center slot. The slots 40 and 41 are parallel and each of the slots 40 and 41 is defined by a pair of continuous flanges 42 and 43, respectively, extending into the supply chamber from the duct 30. The center slot 40 is substantially wider than the side slots 41 and, in the embodiment described for handling conventional 12 ounce aluminum or steel beverage cans, the center slot 40 may have a width of ½ inch. The width of each side slot 41 in the corresponding embodiment is preferably 3/16 inch and the flanges 43 defining the side slots are angled slightly so that the air flows passing therethrough into the duct 30 are convergent. In the embodiment described, the side slots 41 are positioned and angled at about 15 degrees to a plane perpendicular to the end wall to direct flows of air directly against the corners of the cans 16 defining the transition region between the can bottom 33 and the cylindrical can wall 34. The air flow through the center slot 40 on the other hand issues directly perpendicular to the end wall 35 to impinge perpendicularly against the can bottom wall 33.

The orifice pattern in each of the turn section end walls 38 comprises an array 29 of equally spaced perforations 39. The perforations are preferably provided in staggered rows in which the perforations are spaced 1½ inches (3.8 cm) apart and adjacent rows spaced by half that distance or ¾ inch (1.9 cm). This pattern results in mutually perpendicular diagonally extending rows of perforations all of which are equally spaced by approximately 1 inch (2.5 cm), as shown in FIG. 7. The perforations may be ⅜ inch (9.5 mm) in diameter. The width of each array 29 of perforations 39 extending around the turn section end wall 38 may be approximately 3 inches (7.6 cm).

The oppositely disposed side walls 36 include a series of continuous alternately interconnected straight run side walls 44 and turn section side walls 45. The straight run side walls 44 are parallel to one another and the turn section side walls 45 are concentric. The entire extent of both side walls 30, including the straight run and turn sections 44 and 45, are provided with arrays 46 of equally spaced perforations 47. The perforations in the described embodiment are ⅜ inch (9.5 mm) in diameter and the width of each array 46 of perforations is approximately equal to the height of the conventional can 16. Heated pressurized air from the supply chamber 13 passes through the arrays of perforations 47 in the opposed side walls 36 to impinge perpendicularly against the cylindrical can walls 34. The perforations 47 are oriented and spaced in the same manner as the perforations 39 forming the end wall turn section arrays 29. However, the width of the side wall array is preferably about 4.5 inches (11.4 cm).

In order to assure uniform pressure and velocity of the air flows through the duct end wall 35 and side walls 36, the supply chamber 13 is provided with pressure equalization chambers between the main portion of the supply chamber and the walls of the duct 30. Thus, an end wall pressure equalization chamber 48 extends along and encloses the rear face of the end wall 35 along its full length including the straight run portions 37 and the turn sections 38. The rear wall 50 of the pressure equalization chamber 48 is perforated over its entire extent to provide a relatively small open area relative to its total area, as shown in FIG. 6. In the present embodiment, the rear wall 50 is about 13% open. Similarly, a side wall pressure equalization chamber 51 is provided on the back side of each side wall 36 of the duct 30. The rear wall 52 of each pressure equalization chamber 51 is also provided with a pattern of perforations providing approximately 13% open area. The perforated rear walls 50 and 52 of the pressure equalization chambers 48 and 51, respectively, allow the somewhat turbulent flow of heated air in the supply chamber 13 to be modulated and distributed more evenly along the rear faces of the end wall 35 and side walls 36 and thereby provide more evenly distributed air flows through the slots and perforations against the cans 16 traveling in the duct 30. The end wall pressure equalization chamber 48 is preferably provided with a series of baffle plates 53 spaced along the interior of the chamber to further assist in the equalization of pressure within the chamber 48 and to further enhance the uniformity of flow through the slots 40 and 41. As may best be seen in FIG. 4, the baffle plates include cutout portions 54 to accommodate the flanges 42 and 43 and to provide open corners, and a rear edge 55 spaced from the rear wall 50 of the chamber defining an open space along the full length of the chamber. The baffle plates 53 may be located at intervals of approximately 2 feet along the length of the chamber 48.

The dividing wall 56 between the main portion 31 of the drying chamber 14 and the return chamber 15 must also be provided with openings to allow the return flow of drying air. Further, as is well known in the art, the total open space in the dividing wall 56 must be substantially larger than the open spaces provided by the orifices in the duct 313 or in the entries to the pressure equalization chambers 48 and 51, to assure that an adequate pressure drop into the drying chamber 14 is maintained. In the present embodiment, the dividing wall 56 is provided with an equally distributed pattern of perforations providing approximately 13% open surface over its full area, providing a substantially larger total open area than the more limited areas in the duct or the pressure equalization chamber walls.

It is presently preferred to provide a flow volume of heated air sufficient to generate air velocities through the perforations 47 in the side walls 36 of approximately 7,000 fpm and through the slots 40 and 41 in the end wall 35 of approximately 5,000 fpm. The foregoing flow velocities of drying air into the duct 30 and against the outside surfaces of the cans have been found to stabilize the cans on the carrier pins 21 and to provide very rapid and uniform drying of the coatings applied to can surfaces. As a result, the conveyor chain 17 may be driven at substantially higher speeds and, by using the large diameter turn sections 20 defined by the semicircular array of small diameter sprockets 22, the affects of centrifugal force at higher chain speeds is minimized. The drying air is heated to a temperature of up to 415° F. (213° C.), thereby avoiding can-damaging high temperatures and conserving energy. An improved pin oven designed and constructed in accordance with the foregoing specifications is capable of drying the ink and overvarnish coating on 2,400 cans per minute with the conveyor chain operating at a speed in excess of 1,000 feet per minute and with a can dwell time in the oven of about 4 seconds. Compared to a conventional pin oven, the pin oven system of the present invention is very substantially smaller in overall size, may require as little as 1/10th the length of conveyor chain within the oven housing, requires lower horsepower drive and blower motors, and only about half the thermal energy. In addition, the capacity of the oven of the present invention is at least 50% greater than currently available pin ovens.

Various modes of carrying out the present invention are contemplated as being within the scope of the following claims particularly pointing out and distinctly claiming the subject matter which is regarded as the invention.

We claim:

1. A can drying system for open-ended cylindrical cans mounted on generally horizontal elongate carrier pins attached to a conveyor chain in spaced relation therealong for movement in a serpentine chain path defined by a series of straight runs connected by generally curved turn sections, the path disposed in a generally vertical plane, said system comprising:

an open-faced generally U-shaped duct for each straight run positioned parallel to and spaced from the conveyor chain forming the run such that the carrier pins and cans mounted thereon extend into the duct, said duct having an end wall and a pair of opposing side walls extending generally perpendicularly from the end wall, the end wall positioned generally parallel to and spaced from the closed bottom walls of the cans and the side walls positioned generally parallel to and spaced from the cylindrical walls of the cans;

the end wall and side walls of said duct each having a pattern of orifices extending uniformly along the length of the duct for directing pressurized heated air through the duct walls in generally perpendicular directions against the bottom and cylindrical walls of the cans;

the end wall orifice pattern comprising a series of parallel slots extending along the length of the duct, including a center slot aligned with the straight run of the chain to direct a flow of heated air directly against the bottom walls of the can, and a side slot positioned on each side of the center slot to direct converging flows of heated air against the corners of the cans defined by the junctures of the can bottoms and cylindrical walls; and, means for driving said conveyor chain and for carrying the cans through the serpentine path.

2. A can drying system for open-ended cylindrical cans mounted on generally horizontal elongate carrier pins attached to a conveyor chain in spaced relation therealong for movement in a serpentine chain path defined by a series of straight runs connected by generally curved turn sections, the path disposed in a generally vertical plane, said system comprising:

an open-faced generally U-shaped duct for each straight run positioned parallel to and spaced from the conveyor chain forming the run such that the carrier pins and cans mounted thereon extend into the duct, said duct having an end wall and a pair of opposing side walls extending generally perpendicularly from the end wall, the end wall positioned generally parallel to and spaced from the closed bottom walls of the cans and the side walls positioned generally parallel to and spaced from the cylindrical walls of the cans;

the end wall and side walls of said duct each having a pattern of orifices extending uniformly along the length of the duct for directing pressurized heated air through the duct walls in generally perpendicular directions against the bottom and cylindrical walls of the cans;

a U-shaped curved duct section for each curved turn section, each of said duct sections interconnecting the ends of an adjacent pair of straight run ducts;

each duct section having a curved end wall and a pair of concentric opposed curved side walls;

the curved end wall and curved side walls of said duct sections having patterns of orifices extending uniformly along the duct section length contiguous with the orifice patterns for the interconnected straight run ducts; and, means for driving said conveyor chain and for carrying the cans through the serpentine path.

3. The system as set forth in claim 1 wherein the orifice patterns in the side walls are identical and comprise an array of equally spaced perforations, said array positioned directly adjacent the cylindrical can walls and having a width approximately equal to the height of the cans.

4. The system as set forth in claim 2 wherein the orifice patterns for said straight run ducts and said curved duct sections comprise:

a first array of equally spaced perforations extending along the full length of said end walls; and, a second array of equally spaced perforations extending along the full length of said side walls.

5. The system as set forth in claim 4 wherein:

said first arrays of perforations are aligned generally with the path of movement of the chain and have widths approximately equal to the diameter of the cans; and, said second arrays of perforations are positioned directly adjacent the cylindrical can walls and have widths approximately equal to the height of the cans.

6. A can drying system for open-ended cylindrical cans mounted on generally horizontal elongate carrier pins attached to a conveyor chain in spaced relation therealong for movement in a serpentine chain path defined by a series of straight runs connected by generally curved turn sections, the path disposed in a generally vertical plane, said system comprising:

an open-faced generally U-shaped duct for each straight run positioned parallel to and spaced from the conveyor chain forming the run such that the carrier pins and cans mounted thereon extend into the duct, said duct having a straight end wall and a pair of opposing straight side walls extending generally perpendicularly from the end wall, the straight end wall positioned generally parallel to and spaced from the closed bottom walls of the cans and the straight side walls positioned generally parallel to and spaced from the cylindrical walls of the cans;

the straight end wall and side walls each having a pattern of orifices extending uniformly along the length of the duct;

a U-shaped curved duct section for each curved turn section, each of said duct sections interconnecting the ends of an adjacent pair of straight run ducts;

each duct section having a curved end wall adjoining and continuous with the duct end wall and a pair of concentric opposed curved side walls adjoining and continuous with the duct side walls;

the curved end wall and curved side walls of said duct sections having patterns of orifices extending uniformly along the duct section length contiguous with the orifice patterns for the interconnected straight run ducts;

said patterns of orifices including a series of parallel slots extending along the full lengths of said straight end walls and a first array of spaced perforations extending along the full length of each adjoining curved duct section end wall;

second arrays of spaced perforations extending along the full lengths of said duct side walls and the adjoining curved duct section side walls;

means for directing pressurized heated air through said slots and perforations in generally perpendicular directions against the bottom and cylindrical walls of the cans; and, means for driving said conveyor chain and for carrying the cans through the serpentine path.

7. The system as set forth in claim 6 wherein said series of parallel slots comprises:

a center slot aligned with the chain path to direct a flow of heated air directly against the bottom walls of the cans; and, a side slot positioned on each side of the center slot to direct converging flows of heated air against the corners of the cans defined by the junctures of the can bottoms and cylindrical walls.

8. The system as set forth in claim 7 wherein said center slot is wider than either of said side slots.

9. The system as set forth in claim 8 wherein said center slot is greater than twice the width of either of said side slots.

10. The system as set forth in claim 7 wherein said first arrays of perforations are positioned directly adjacent the can ends and have widths approximately equal to the diameter of the cans, and said second arrays of perforations are positioned directly adjacent the cylindrical can walls and have widths approximately equal to the height of the cans.

11. A can drying system for open-ended cylindrical cans mounted on generally horizontal elongate carrier pins attached to a conveyor chain in spaced relation therealong for movement in a serpentine chain path defined by a series of straight generally parallel runs connected by generally semicircular curved turn sections, the chain path disposed in a generally vertical plane and enclosed within a heated drying chamber, said system comprising:

a continuous duct for each straight run and connecting turn section positioned along the path of and spaced from the conveyor chain such that the carrier pins and cans mounted thereon extend into the duct, said duct having an end wall and a pair of side walls, the end wall and side walls of said duct each having a pattern of orifices extending uniformly along the length of the duct for directing pressurized heated air through the duct walls against the bottom and cylindrical walls of the cans;

a series of sprockets mounted within the drying chamber and supporting the chain for movement around each turn section, said sprockets spaced circumferentially along the generally semicircular curve of the turn section such that the chain between each adjacent pair of said sprockets lies generally on a chord of the curve, each sprocket having a diameter less than half the diameter of the curve; and, means for driving said conveyor chain and for carrying the cans through the serpentine path.

12. The system as set forth in claim 11 wherein said series of sprockets comprises five identical sprockets having diameters approximately equal to one-fourth the diameter of the curve.

13. The system as set forth in claim 11 wherein said side walls extend generally perpendicularly from the end wall, the end wall is positioned generally parallel to and spaced from the closed bottom walls of the cans and the side walls are positioned generally parallel and spaced from the cylindrical walls of the cans.

* * * * *